US006206552B1

(12) United States Patent
Kuo

(10) Patent No.: US 6,206,552 B1
(45) Date of Patent: Mar. 27, 2001

(54) ANTI-LUXATION DEVICE FOR CLASPER OF POWER-SUPPLY WIRES IN A LAMP STRING

(76) Inventor: Cheng-Ji Kuo, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/409,776

(22) Filed: Sep. 29, 1999

(51) Int. Cl.[7] ..... F21V 21/00
(52) U.S. Cl. ..... 362/391; 362/252; 362/396
(58) Field of Search ..... 362/123, 249, 362/252, 391, 396, 806

(56) References Cited

U.S. PATENT DOCUMENTS 5,775,802 7/1998 Kuo ..... 362/396
5,800,046 * 9/1998 Lin ..... 362/252
5,941,628 * 8/1999 Chang ..... 362/249
6,106,138 * 8/2000 Wei ..... 362/252

* cited by examiner

*Primary Examiner*—Stephen Husar

(57) ABSTRACT

An anti-luxation device for clasper of power-supply wires in a lamp string, which mainly comprises a clasper of socket; the clasper includes a wide wall plate and a top flat surface, between which an arm plate extends outwards, and the tail end of the arm plate has a hook hole; the arm plate is connected with the clasper by means of a bendable thin plate; after the arm plate is bent upwards, it will be in contact with the hook furnished and extended out between the cylindrical surface of the socket and the top flat surface, and then the hook hole and the hook can be mated together with a light pressing force without luxation between the clasper and the socket upon the power-supply wires being pulled unintentionally.

2 Claims, 8 Drawing Sheets

ANTI-LUXATION DEVICE FOR CLASPER OF POWER-SUPPLY WIRES IN A LAMP STRING

BACKGROUND OF THE INVENTION

1. Field of the Invention

This invention relates to an ornamental lamp, and particularly to an ornamental lamp which is furnished with a device to prevent the clasper becoming luxated from the socket.

2. Description of the Prior Art

In conventional ornamental lamp string for Christmas, a long lamp string usually comprises a plurality of short lamp strings connected in series; each short lamp string includes a plurality of sockets mounted with bulbs respectively; each short lamp string includes a flickering bulb, which is used as a switch to control the power supply go the rest bulbs in the string so as to have the whole lamp string flickered as an ornamental means.

In another conventional ornamental lamp string for Christmas, it is used for decorating a large area, such as a wall or the like; such a lamp string has two power-supply wires, of which each is connected with a plurality of sockets in series; one end of each of the two power-supply wires is directly connected with a main bulb of power-supply wires, or connected through a connecting member. All lamp strings are connected with the main cable of power-supply wires respectively so as to form into a large lamp string to be hung on a wall surface or the like for ornamental purpose; however, the aforesaid large lamp string is subject to twisting together at least partially upon being blown with wind; therefore, such lamp string is usually fastened in place with a net; in that case, the lamp string would cause more or less inconvenience upon being set up or removed from a site.

In the conventional clasper device for the power-supply wires of a lamp string, please reference U.S. Pat. No. 5,775,802, the clamp device according to that invention has been commercialized, and it is used for connecting a plurality of lamp strings into a lamp network to be mounted on a wall or a large flat surface; however, any one socket in the lamp strings might be luxated from the clasper thereof in case of being pulled with a force "P" as shown in FIG. 8.

SUMMARY OF THE INVENTION

The prime object of he present invention is to provide a device to improve the drawbacks of the invention as mentioned in the aforesaid U.S. Pat. No. 5,775,802; by means of the improved device, the clasper can be fastened to the socket firmly without being luxated upon the power-supply wires being pulled unintentionally.

Another object of the present invention is to provide a device, in which the clasper mounted on the socket has an arm plate extended out of a wide wall plate thereof; the tail end of the arm plate has a hook hole; the other end of the arm plate is connected with the wide wall plate by means of a bendable thin plate; when the arm plate is bent upwards, the hook hole can be mated with the hook furnished on the cylindrical surface so as to prevent the clasper becoming luxated from the socket upon being pulled unintentionally.

Still another object of the present invention is to provide a device, in which the hook on the cylindrical surface merely projects a little bit out of the cylindrical surface after the lamp strings being assembled together; in other words, the small projected part out of the cylindrical surface would not affect the connection operation between the socket and the power-supply wires.

A further object of the present invention is to provide a device, in which the arm plate extended out of the wide wall plate of the clasper can be bent upwards by means of the bendable thin plate; the hook hole on the tail thereof is to be mated with a hook furnished on the cylindrical surface, and also the hook hole is to be mated with a hook furnished on one side of the clasper.

DETAILED DESCRIPTION OF THE PREFERRED EMBODIMENT

Figure 1:
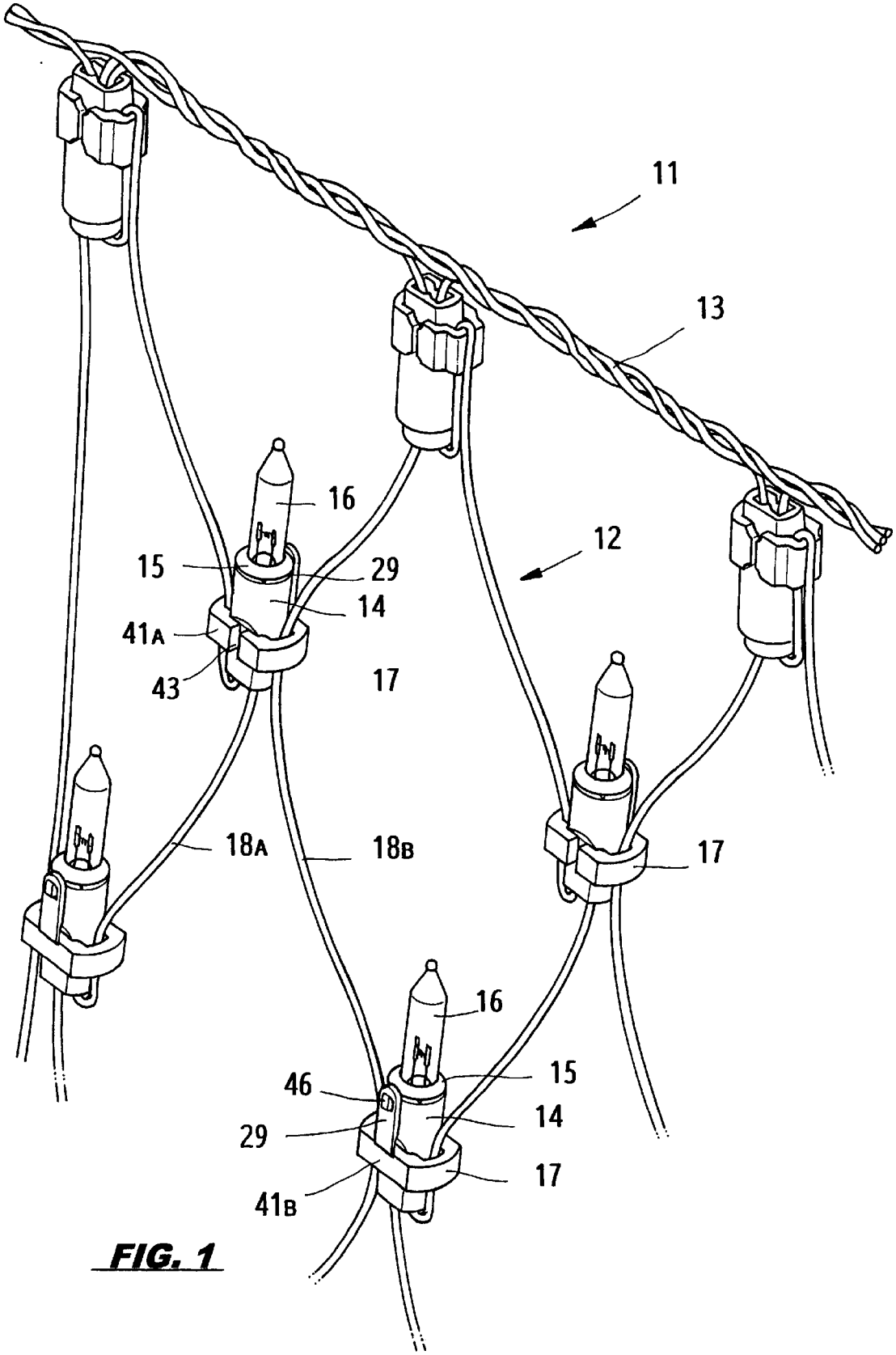
FIG. 1 is a perspective view of the present invention, showing a given number of lamp strings formed into a lamp network.
Figure 2:
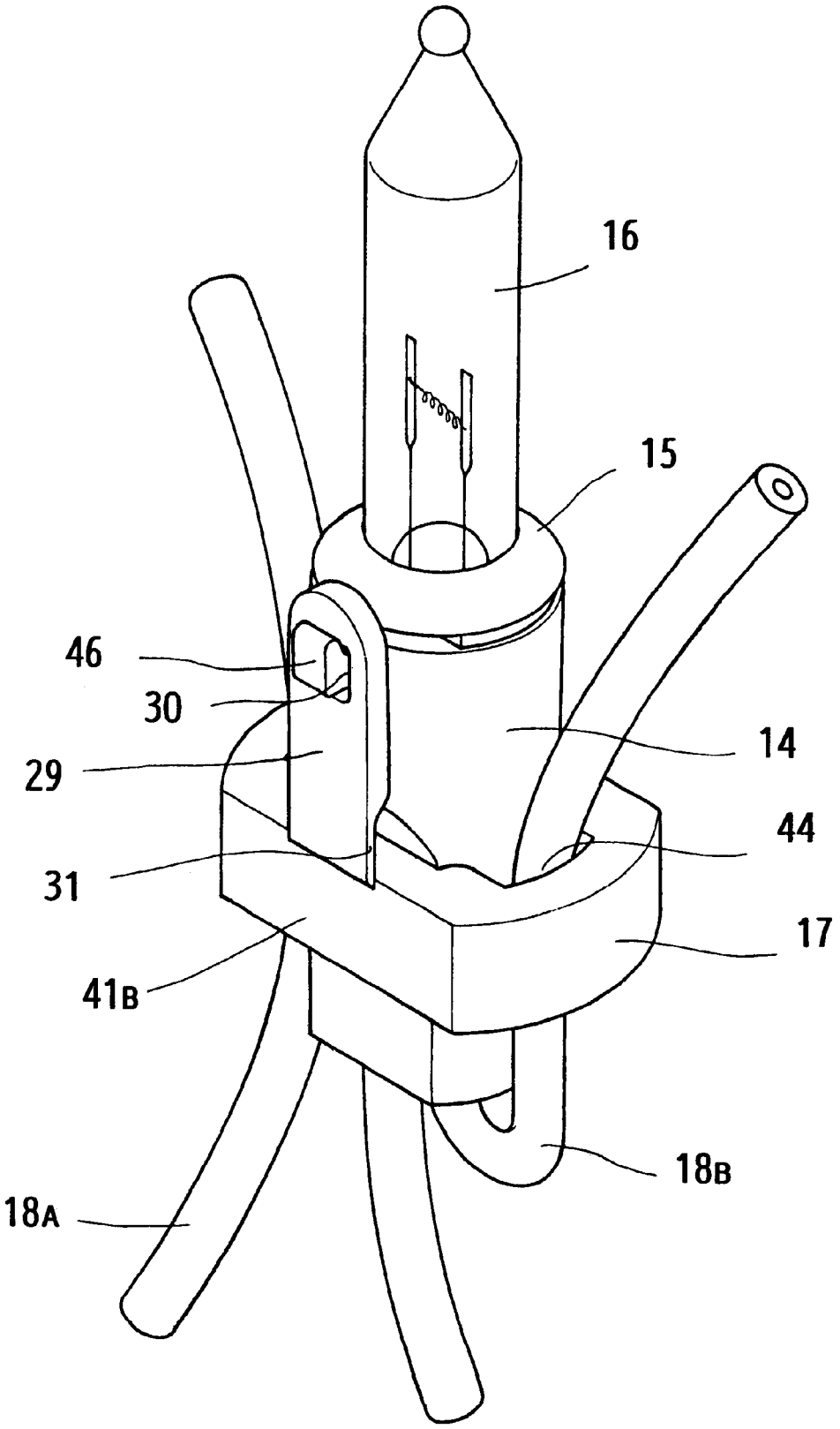
FIG. 2 is a perspective view of the present invention, showing a single socket being held in place with a clasper.
Figure 3:
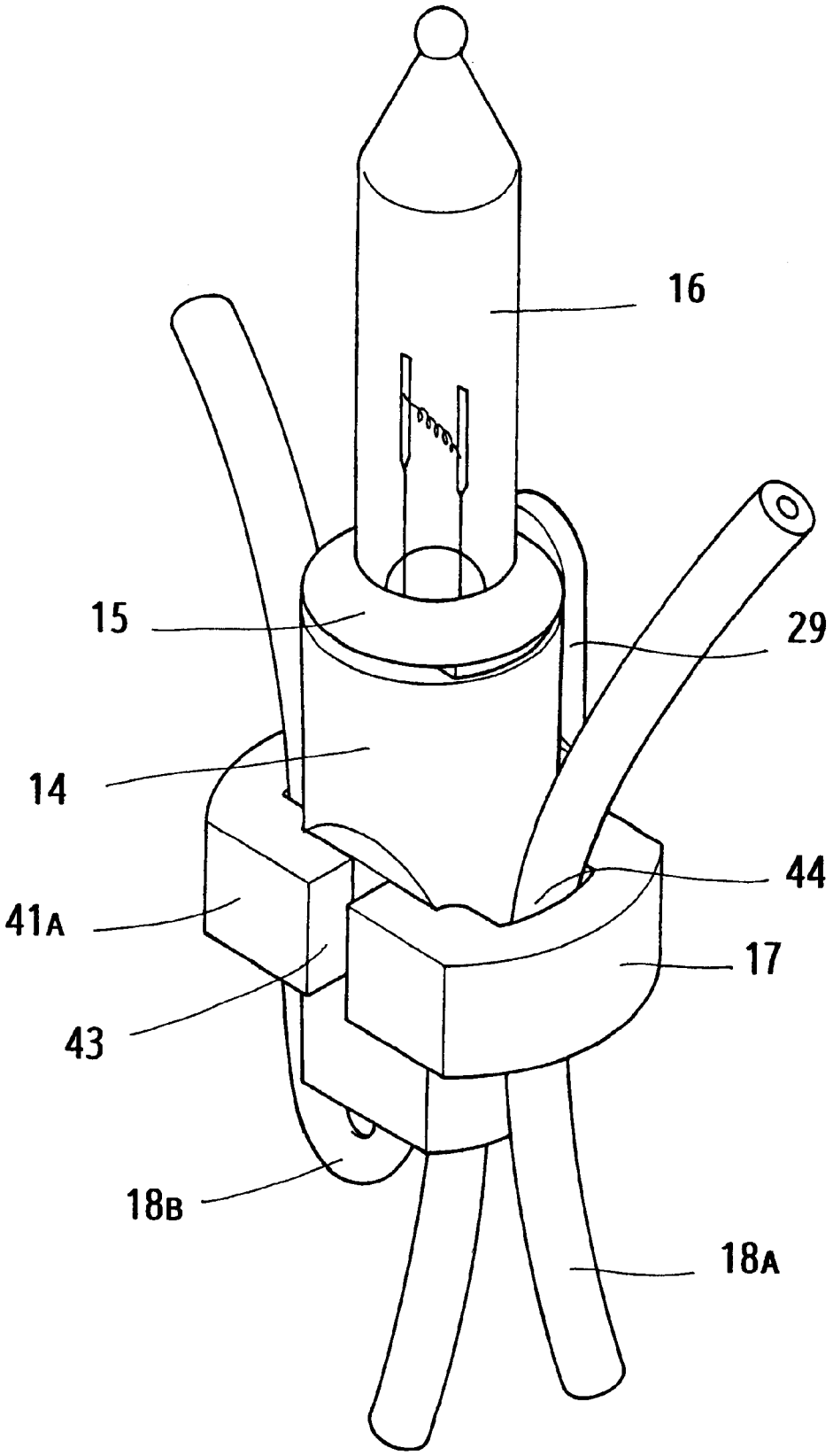
FIG. 3 is a perspective view of the present invention, showing a second-direction clamp structure.
Figure 4:
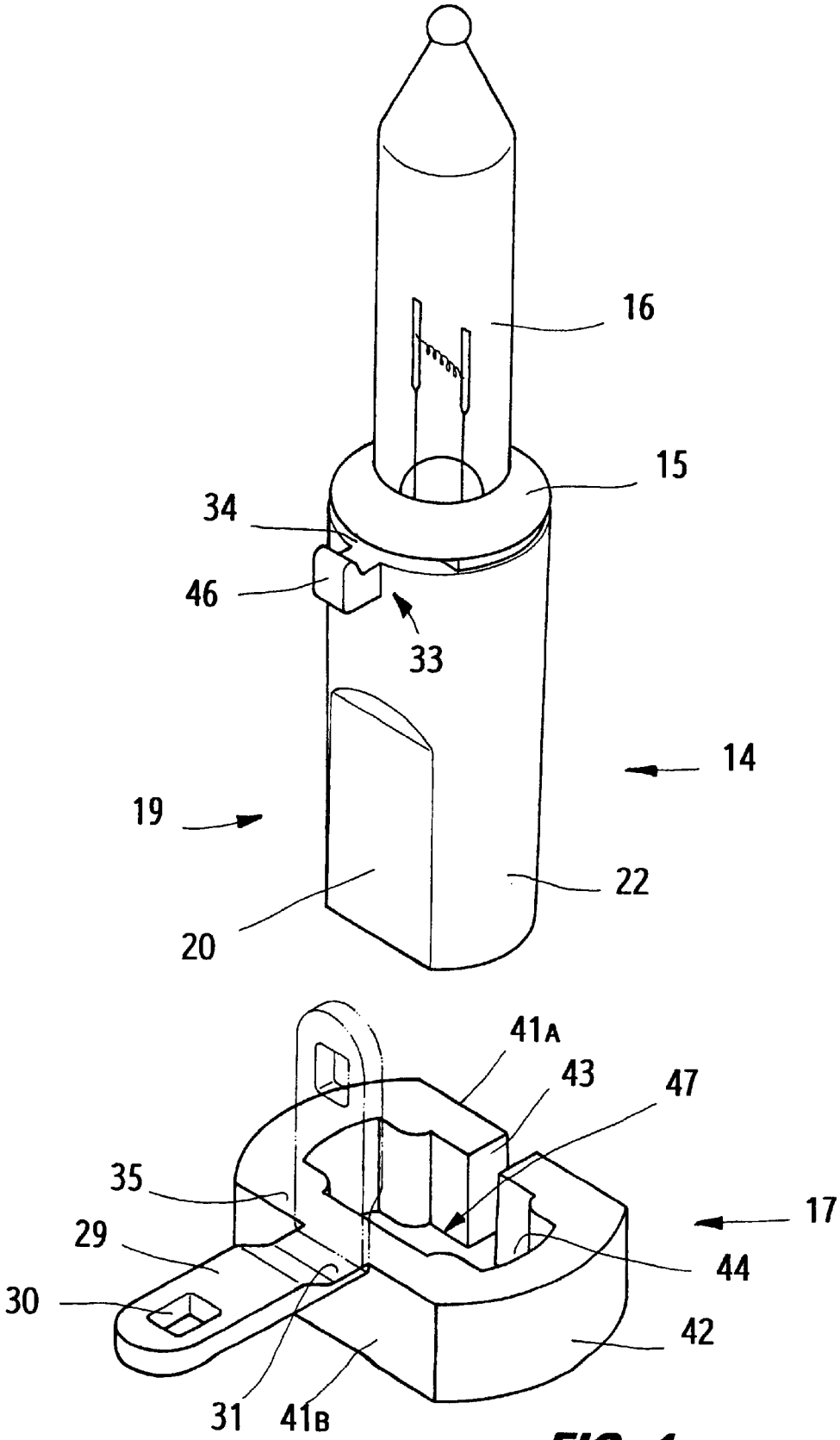
FIG. 4 is a disassembled view of the present invention, showing a connector with an arm plate separated from the socket with a hook.
Figure 5:
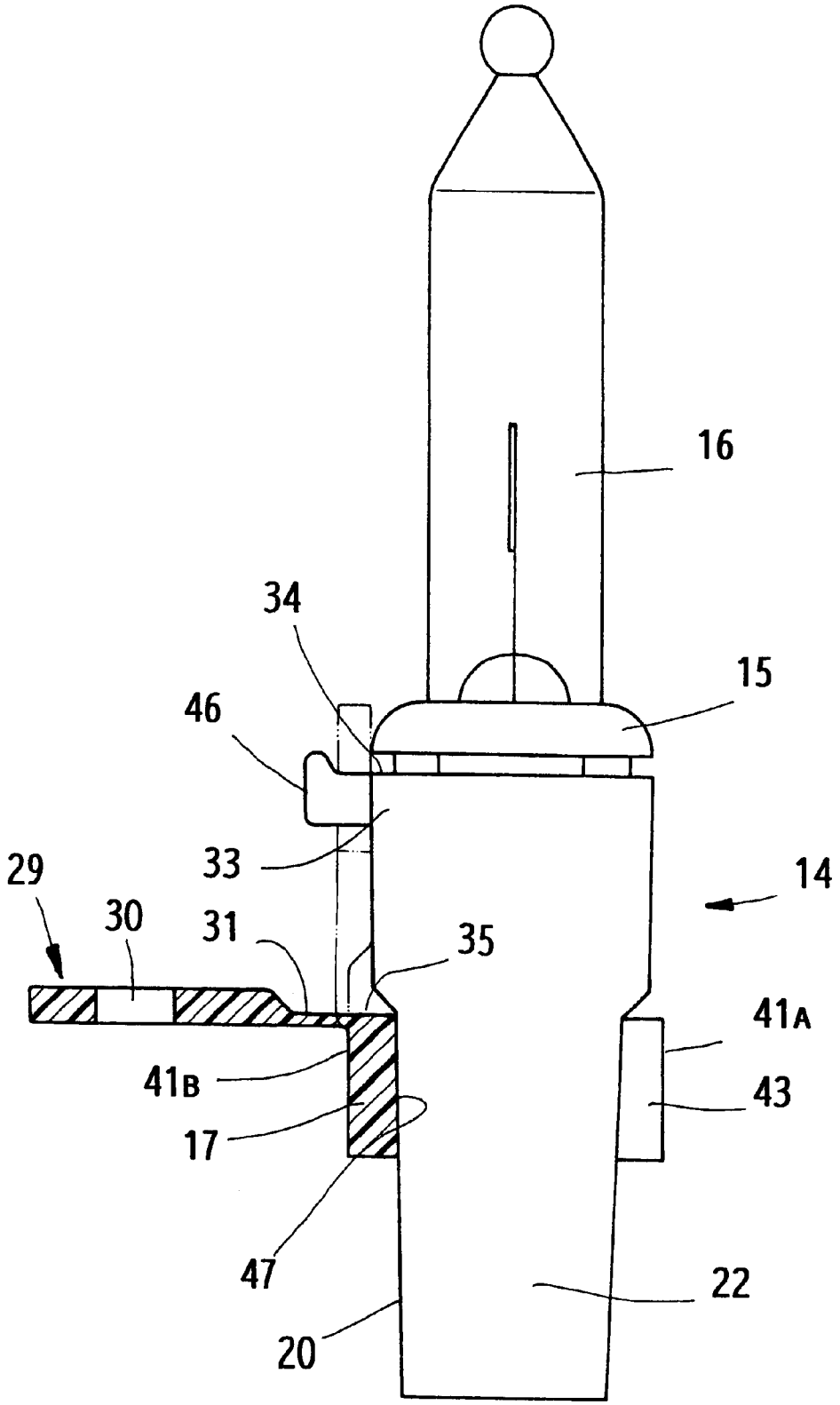
FIG. 5 is a sectional view of the present invention, showing the hooking structure as showing in FIG. 4.

Referring to FIG. 1, it shows a lamp network made of a plurality of ornamental lamps, and it comprises a main power-supply cable 13 and a plurality of lamp strings 12; each lamp string is connected with one socket of the main power -supply cable 13 by means of a connecting member 15. Each lamp string 12 includes an independent power-supply wire 18A and an independent Power-supply wire 18B to connect a plurality of sockets in series; the base surface 19 of every socket 14 in each lamp string 12 is mounted with a clasper 17, of which the lamp chute 44 is used for holding the power-supply wire 18B in place. In the network ornamental lamp 11, the upper part of each socket 14 has a fastening member 27 mounted around the bulb 16; the tail end of an arm plate 29 of the fastening member 27 has a hook hole 30 to be mated with a hook 46 of an arm plate 45 extended out of the clasper 17 so as to prevent the clasper 17 from luxating.

Referring to FIGS. 1 to 5, one end of each socket 14 in each lamp string 12 has a connector 15 to be mounted with a bulb 16, while the other end thereof has a guide chute for receiving power-supply wires 18. Both sides of the guide chute are furnished with two symmetrical flat surfaces 20 and two symmetrical curved surfaces 22 respectively so as to provide a socket-positioning surface 19 for mounting the clasper 17.

The clasper 17 to be mounted on the socket-positioning surface 19 of the socket 14 has an outer edge, which includes two symmetrical wide wall plates 41 and two symmetrical curved plates 42; the inside of the clasper 17 has a clamp sleeve 47 for mounting the socket-positioning surface 19 of the socket 14; both sides of clamp sleeve 47 are furnished with two symmetrical clamp chutes 44 respectively. One of the wide wall plate 41 A has a cutout 43, which can facilitate the power-supply wires 18 to be inserted into the clamp sleeve 47 before the clasper 17 being mounted on the socket-positioning surface 19 of the socket 14. Before the clasper 17 is mounted to the socket 14, the power-supply wires should be inserted into the clamp chute 44 first.

In order to prevent the clasper 17 being separated from the socket 14 unintentionally, the wide wall plate 41 B of the clasper 17 without cutout 43 is furnished with an arm plate 29 extended out of the top flat surface 35; the tail end of the arm plate 29 has a hook hole 30; the arm plate 29 is connected with the clasper 17 by means of a bendable thin plate 31 so as to provide the arm plate 29 with a bendable function. Between the hook hole 30 on the tail end of the arm plate 29 and the end of the bendable thin plate 31, there is a given length so as to facilitate the hook hole to mate with a hook 46 on the socket 14.

The hook 46 of the socket 14 is furnished on the cylindrical surface 33 of the flat surface 20 of socket 14, and is nearing the top flat 34 of the socket; the hook 46 faces upwards.

To make a lamp network with a plurality of lamp strings 12, the power-supply wire 18B between two adjacent sockets 14 of two adjacent lamp strings 12 should be inserted, through the cutout 43, into the clamp sleeve 47 of the clasper 17. When the clasper 17 is mounting on the socket-positioning surface 19 of the socket 14, the power-supply wires 18 should be inserted into the clamp chutes 44 on both sides of the clasper 17, i, e., on one side of the socket 14; then, a network of ornamental lamps 11 is completed. A hook 46 is furnished on the top flat 34 of the cylindrical surface 33, and it is to be mated with the hook hole 30 on the tail end of the arm plate 29 upon the plate 29 being bent with the bendable thin plate 31; then, the clasper 17 will not be separated from the socket upon the power-supply wires 18 being pulled unintentionally.

Figure 6:
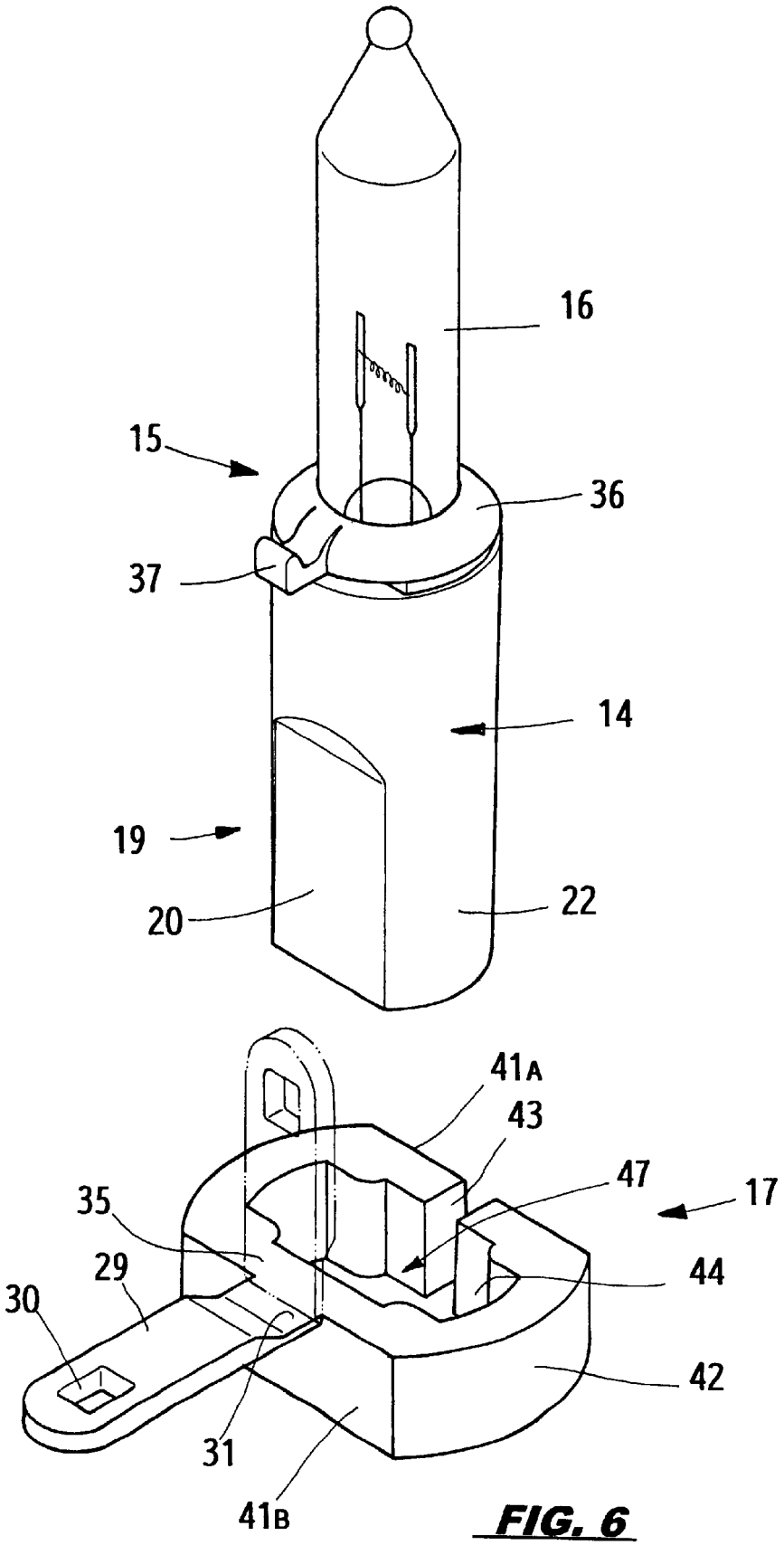
FIG. 6 is a sectional view of the present invention, showing the relation between the arm plate of the clasper and the hook of the connector.
Figure 7:
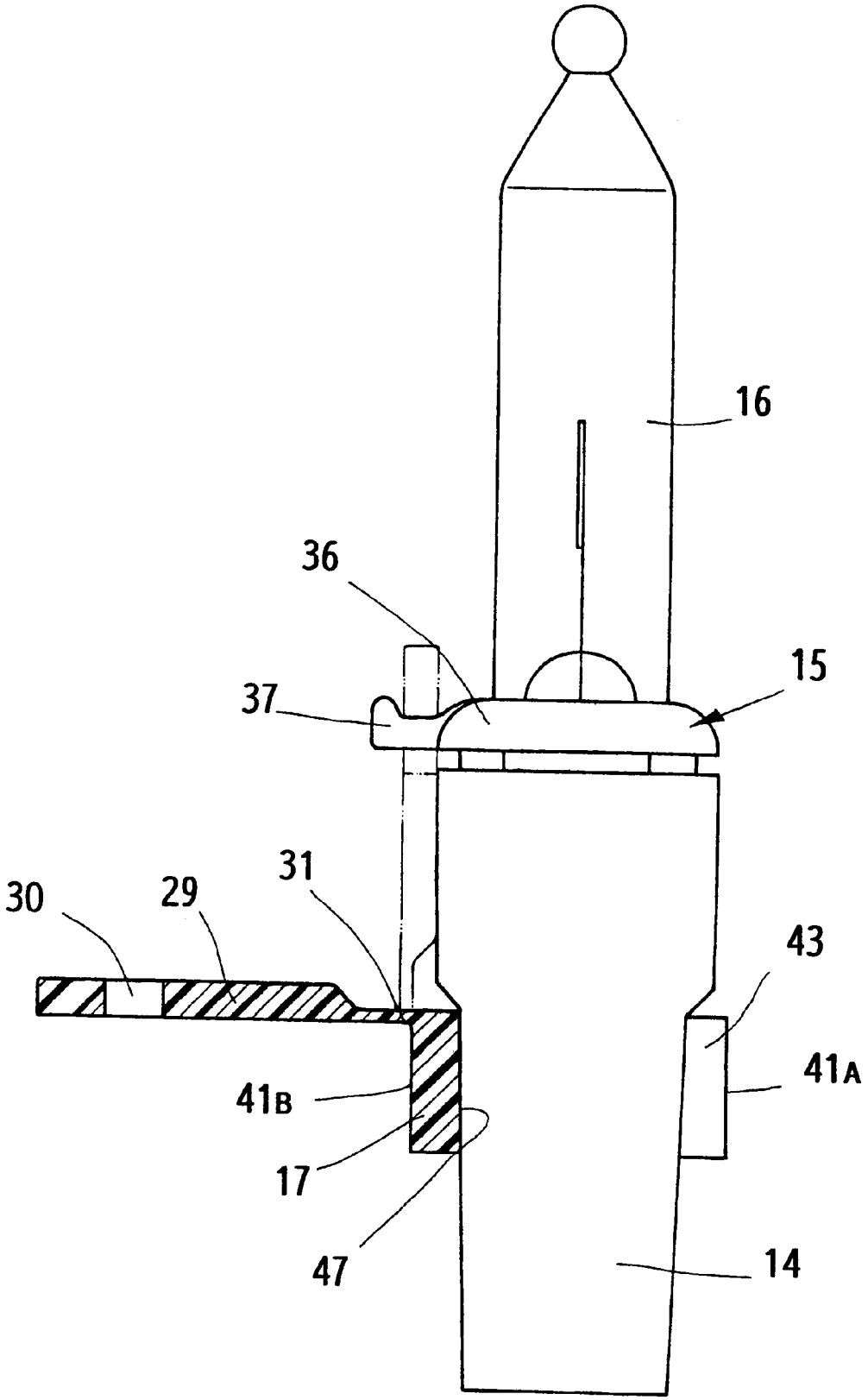
FIG. 7 is a sectional view of the present invention, showing the hooking structure as shown in FIG. 6.
Figure 8:
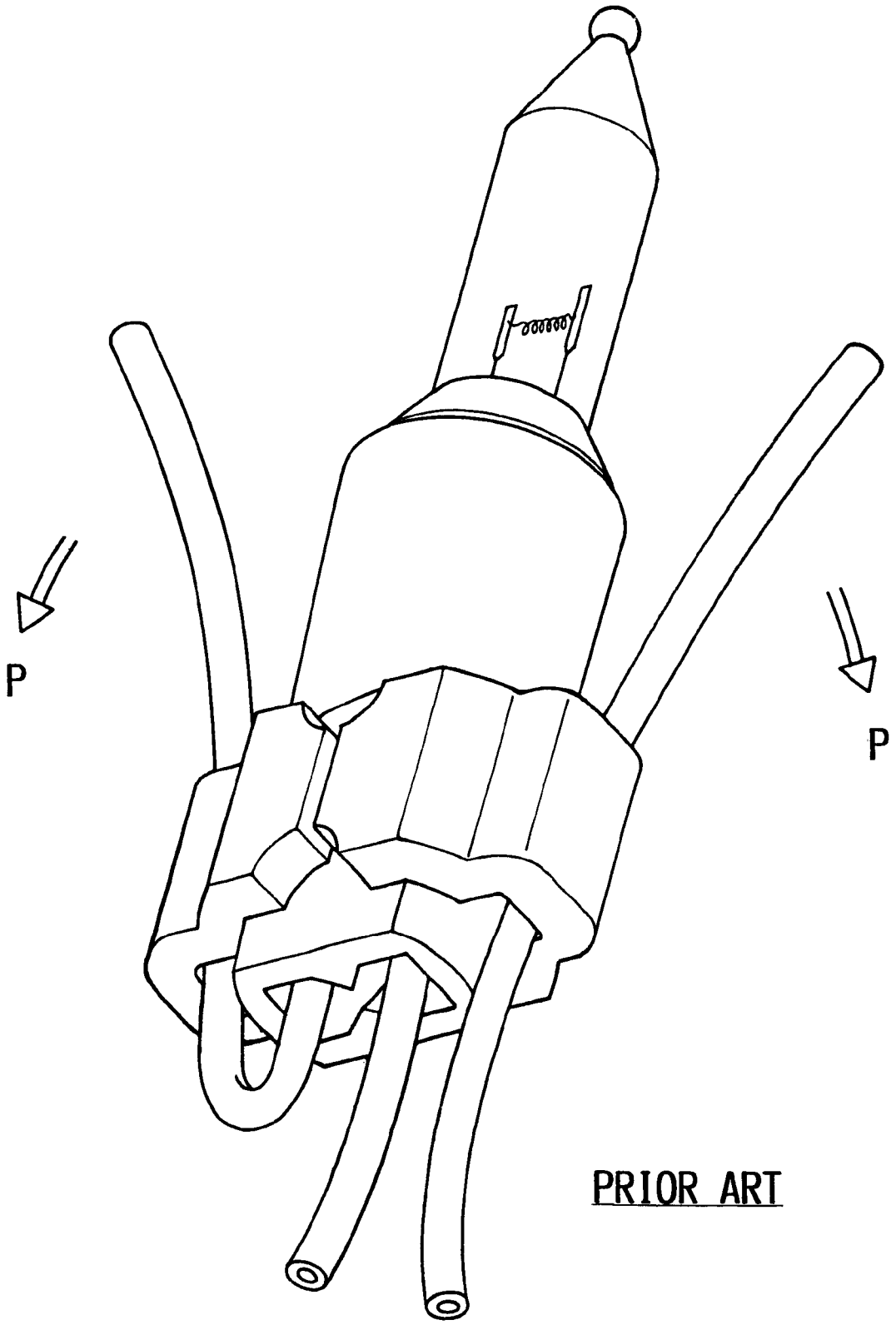
FIG. 8 is a conventional clamp structure for holding a clasper and a socket.

As shown in FIGS. 6 and 7, one side of a water-proof ring 36 on the connector 15 has a hook 37 extended outwards. Between the hook hole 30 on the arm plate 29 of the clasper 17 and the top flat surface 35 of the clasper 17, there is a distance designed to fit the position of the hook 37 on the water-proof ring 36 of the connector 15. To form into a lamp network by means of a plurality of lamp strings, each clasper 17 must be mounted on the socket-positioning surface 19 of the socket 14, and then the arm plate 29 on the clasper 17 will be bent upwards with the bendable thin plate 31; then, the hook hole 30 on the arm plate 29 is moved towards the hook 37 on the water-proof ring 36 of the connector 15 until being mated and fastened together. Each clasper 17 is mounted on one socket 14, and the hook 37 on each water-proof ring 36 of the connector 15 is hooked into a hook hole so as to form into a network of ornamental lamps; in that case, the socket 14 and the clasper 17 will not be separated from each other as a result of unintentionally pulling.

According to the aforesaid embodiment described, the arm plate 29 extended out of the top flat surface 35 on the wide wall plate 41 B of the clasper 17 has been described completely; the arm plate 29 is bendable so as to facilitate the hook hole 30 on the tail end of the arm plate 29 to mate with the hook on the connector 15 or the socket 14, and to prevent the clasper 17 from being luxated upon being pulled unintentionally. According to the structural features of the present invention, it is apparent that the present invention has provided with an improvement, which is never anticipated and shown by any person who is skilled in the field related; therefore, it is deemed a unique disclosure.

What is claimed is:

1. An anti-luxation device for clasper of power-supply wires in a lamp string, and said device used in a clasper for a plurality of sockets and power-supply wires to form into a lamp network with a plurality of lamp strings; said clasper including a clamp sleeve in center thereof, and said clamp sleeve being mounted on a socket-positioning surface of two symmetrical flat surfaces of said socket, and features thereof being described as follows:

said clasper mounted on said socket-positioning surface of said socket having an arm plate furnished on a top flat surface of a wide wall plate which being without a cutout, and tail end of said arm plate having a hook hole; said arm plate and said clasper being connected together with a bendable thin plate; a hook being furnished and extended out between a cylindrical surface of said socket and a top flat surface, and said hook facing upwards; said clasper mounted and fastened on a socket-positioning surface of said socket by means of said hook and said arm plate to bend upwards so as to have said hook and said hook hole mated and pressed together and to prevent said clasper from luxation upon being pulled unintentionally.

2. An anti-luxation device for clasper of power-supply wires in a lamp string as claimed in claim 1, wherein said arm plate extended out between said wide wall plate of said clasper and said top flat surface has a hook hole on tail end thereof, and said hook hole to be mated with said hook extended out of a waterproof ring.

* * * * *